United States Patent [19]

Bucksbaum et al.

[11] 4,390,767

[45] Jun. 28, 1983

[54] WINDOWED AND CHOKED COMBINATION OVEN DOOR

[75] Inventors: Arnold M. Bucksbaum, Cedar Rapids; Buddy J. Austin, Atkins, both of Iowa

[73] Assignee: Amana Refrigeration, Inc., Amana, Iowa

[21] Appl. No.: 229,060

[22] Filed: Jan. 28, 1981

[51] Int. Cl.[3] ..... H05B 6/76

[52] U.S. Cl. ..... 219/10.55 D; 219/10.55 R; 126/200; 174/35 GC

[58] Field of Search ..... 219/10.55 D, 10.55 R, 219/10.55 B; 126/200; 174/35 R, 35 GC, 35 MS

[56] References Cited

U.S. PATENT DOCUMENTS

| | | | |
|---|---|---|---|
| 3,121,158 | 2/1964 | Hurko . | |
| 3,177,334 | 4/1965 | Kinkle | 219/10.55 D |
| 3,311,106 | 3/1967 | Baughman et al. | 126/200 |
| 3,767,884 | 10/1973 | Osepchuk et al. | 219/10.55 D |
| 3,846,608 | 11/1974 | Valles | 219/10.55 D |
| 4,049,939 | 9/1977 | Katona | 219/10.55 D |
| 4,053,731 | 10/1977 | Foerstner | 219/10.55 D |
| 4,146,768 | 3/1979 | Orke et al. | 219/10.55 D |
| 4,166,207 | 8/1979 | Burke | 219/10.55 D |
| 4,206,338 | 6/1980 | Katona | 219/10.55 D |
| 4,211,910 | 7/1980 | Kusunoki et al. | 219/10.55 D |

*Primary Examiner*—B. A. Reynolds
*Assistant Examiner*—Philip H. Leung
*Attorney, Agent, or Firm*—William R. Clark; Joseph D. Pannone

[57] ABSTRACT

A windowed door assembly for a combination microwave and hot air oven having a choke-coupling type seal formed around the periphery of the window opening to suppress the leakage of microwave energy from the area between the main body of the door and the window portion of the door. The window portion is removably connected to the main body of the door in a region of relatively high capacitive impedance to reduce the importance of the mechanical connection in suppressing the leakage of microwave energy from the oven.

10 Claims, 5 Drawing Figures

FIG. 1
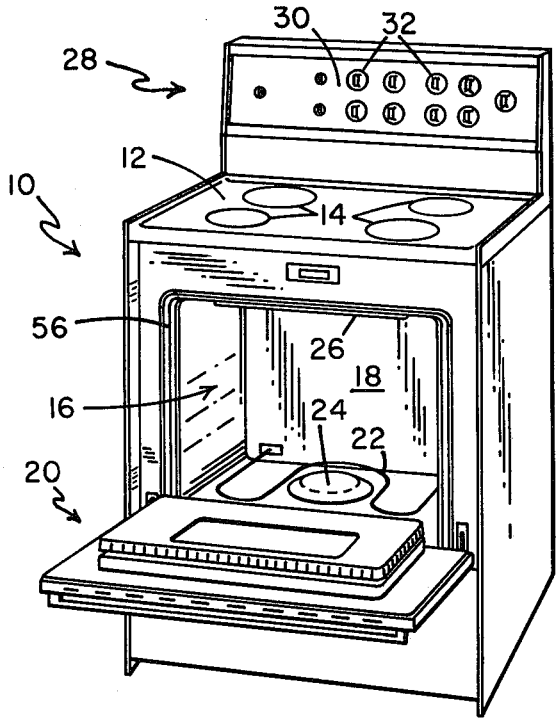
FIG. 3
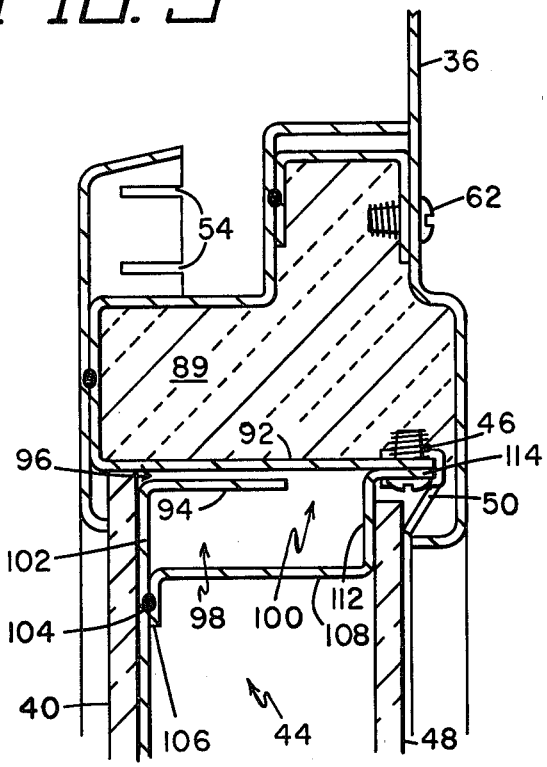
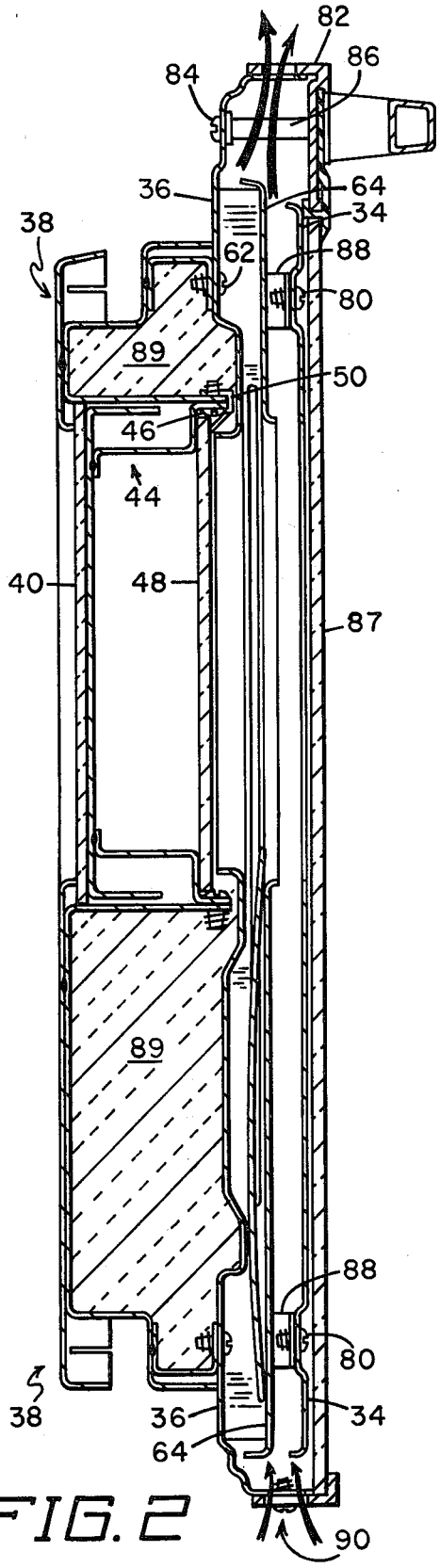
FIG. 2

WINDOWED AND CHOKED COMBINATION OVEN DOOR

BACKGROUND OF THE INVENTION

The invention relates to combination ovens generally and more particularly to a windowed door assembly for a combination microwave and hot air oven.

Combination ovens combining the capability of microwave energy with the capability of radiant energy or circulated hot air are well-known in the art. Numerous forms of these ovens have appeared on the market and are available to the consumer at the retail level. In addition, several U.S. Patents have issued disclosing various aspects of these ovens. For example, U.S. Pat. No. 3,177,334 discloses an oven door window for an oven that is supplied with both microwave and radiant energy where the leakage of microwave energy through the window is deterred by a perforated plate that is an integral part of the door structure. U.S. Pat. No. 3,311,106 discloses a windowed oven door for use with high temperature ovens wherein the oven wall temperature may reach as high as 950° to 1000° F. U.S. Pat. Nos. 4,049,939 and 4,206,338 disclose a microwave and radiant window for oven doors wherein a microwave shield between glass panes is grounded at several points along the four sides of the window to dissipate microwave radiation. U.S. Pat. No. 4,211,910 discloses a door arrangement for a microwave and hot air oven having a glass plate member in front of and on the outer side of a shielding member for reducing leakage of microwave energy at the surface of the glass plate. All of these devices and references have sought to combine the convenience of having a window in an oven door to allow the user to monitor the progress of the cooking process with the additional design considerations involved with operating an oven that has a microwave or a self-cleaning capability.

Apart from these efforts to suppress the leakage of microwave or radiant energy from an oven door window, there have been efforts to suppress the leakage of these energies from the area between the main body of the oven and the oven door. The most notable of these seals is the choke-coupling type seal. Its major advantage lies in the fact that it does not rely on mechanical contact and the attendant problems of material deterioration for its sealing effectiveness. It does this by presenting a capacitive impedance at the opening to the choke cavity, thus establishing an E field. No H field can exist at the choke opening. Without an E cross H field, electromagnetic energy cannot be transmitted and, therefore, energy cannot leak from the oven.

U.S. Pat. No. 4,053,731 describes one such choke. Numerous others are described in U.S. Pat. No. 4,166,207. Yet, heretofore, no one has combined the advantages of the choke-coupling type seal with the convenience of a window in an oven door.

SUMMARY OF THE INVENTION

According to the invention, there is provided a windowed door for a combination microwave and hot air oven wherein the periphery of the window is capacitively choked to suppress the leakage of microwave energy.

The primary object of the invention is to provide a windowed door for a combination oven that will prevent the escape of microwave energy around the perimeter of the window into the door or to the outside through the use of a choke-coupling type seal.

Another object of the invention is to provide a windowed door for a combination oven that does not rely on mechanical contact around the perimeter of the window to prevent the leakage of microwave energy.

Another object is to provide a window subassembly for a door assembly of a combination oven that, since it does not rely on mechanical contact around its perimeter to prevent microwave leakage, is easily removable in case of breakage, damage or the like.

A further object is to provide an oven window that is capacitively choked and can withstand the high temperatures generally associated with self-cleaning ovens.

Other objects and advantages of the invention will become apparent from the following description, the accompanying drawings and the appended claims.

BRIEF DESCRIPTION OF THE DRAWINGS

FIG. 1 is a perspective view of a free-standing range having a windowed oven door embodying the present invention.

FIG. 2 is a cross-sectional side view on an enlarged scale through the center of the door of FIG. 1 to show the various components of the door.

FIG. 3 is a cross-sectional side view on an enlarged scale through the center of the door of FIG. 2 with portions broken away to emphasize the construction of the capacitive sealing portion of the door.

DESCRIPTION OF THE PREFERRED EMBODIMENT

Figure 4A:
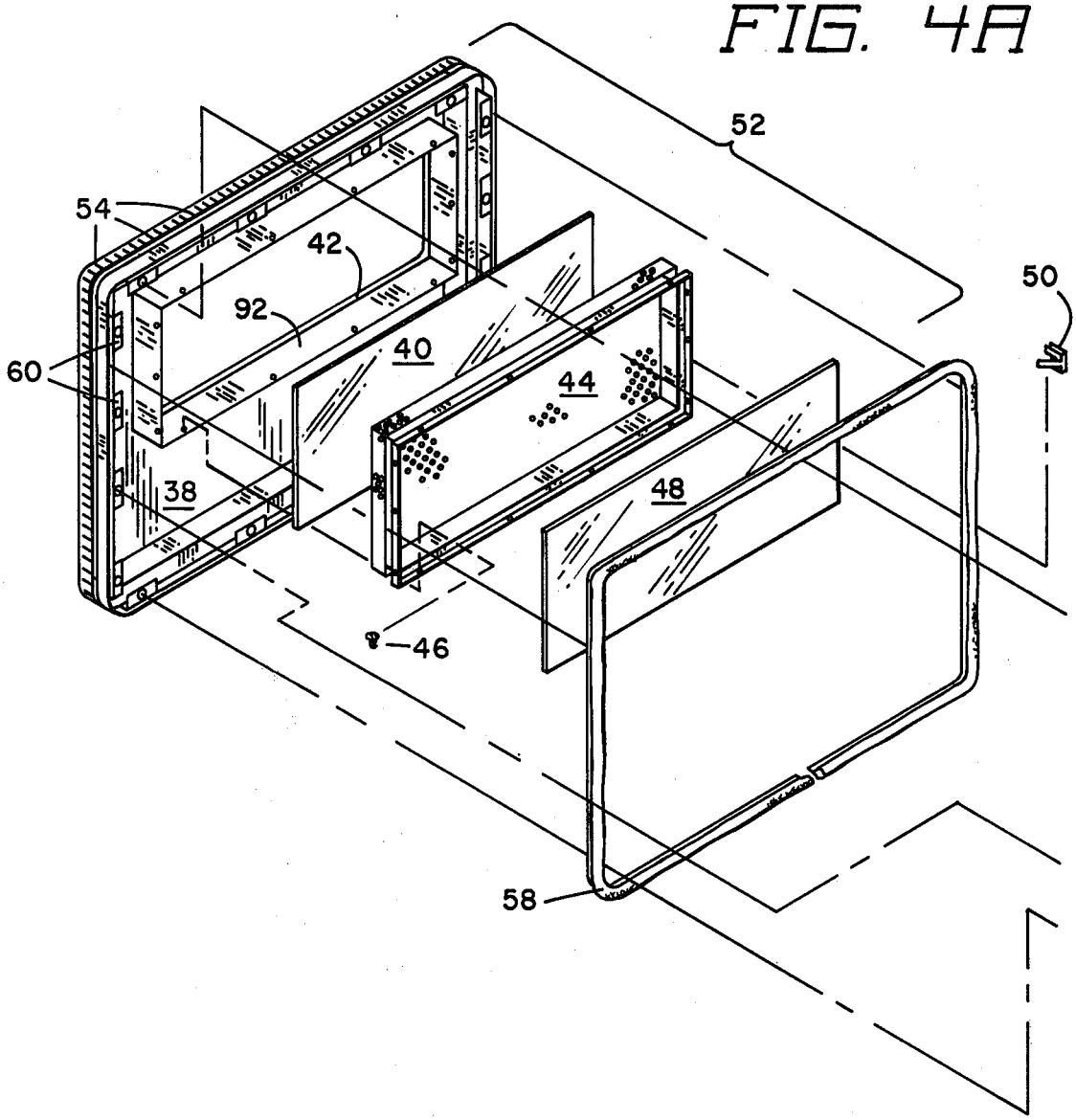
FIGS. 4A and 4B are an exploded, perspective view of the door of FIG. 1.

Referring to all of the figures wherein like numbers refer to like parts and more particularly to FIG. 1, there is shown for illustrative purposes a free standing electric and microwave range 10 having a top cooking service 12 with a plurality of surface heating elements 14, a baking oven 16 formed by a box-like oven liner 18 and a front opening, drop down door 20. Of course, this invention is not limited to use in electric and microwave free standing ranges. The oven could be heated by gas, it could be a built-in oven, or any other type of microwave oven cavity.

The oven cavity is supplied with a lower baking element 22, a microwave feed 24 and an upper broiling element 26 located adjacent the top wall of the oven liner. The back edge of the cooking surface 12 is supplied with a back splash 28 which supports a control panel 30 including multiple switches 32 for controlling the oven operations. Exemplary, the heating elements and their controls may be arranged and operated as described in U.S. Pat. No. 3,121,158 which is hereby incorporated by reference. Similarly, the microwave feed and its controls may be arranged and operated in any number of ways as is well-known in the art.

Figure 4B:
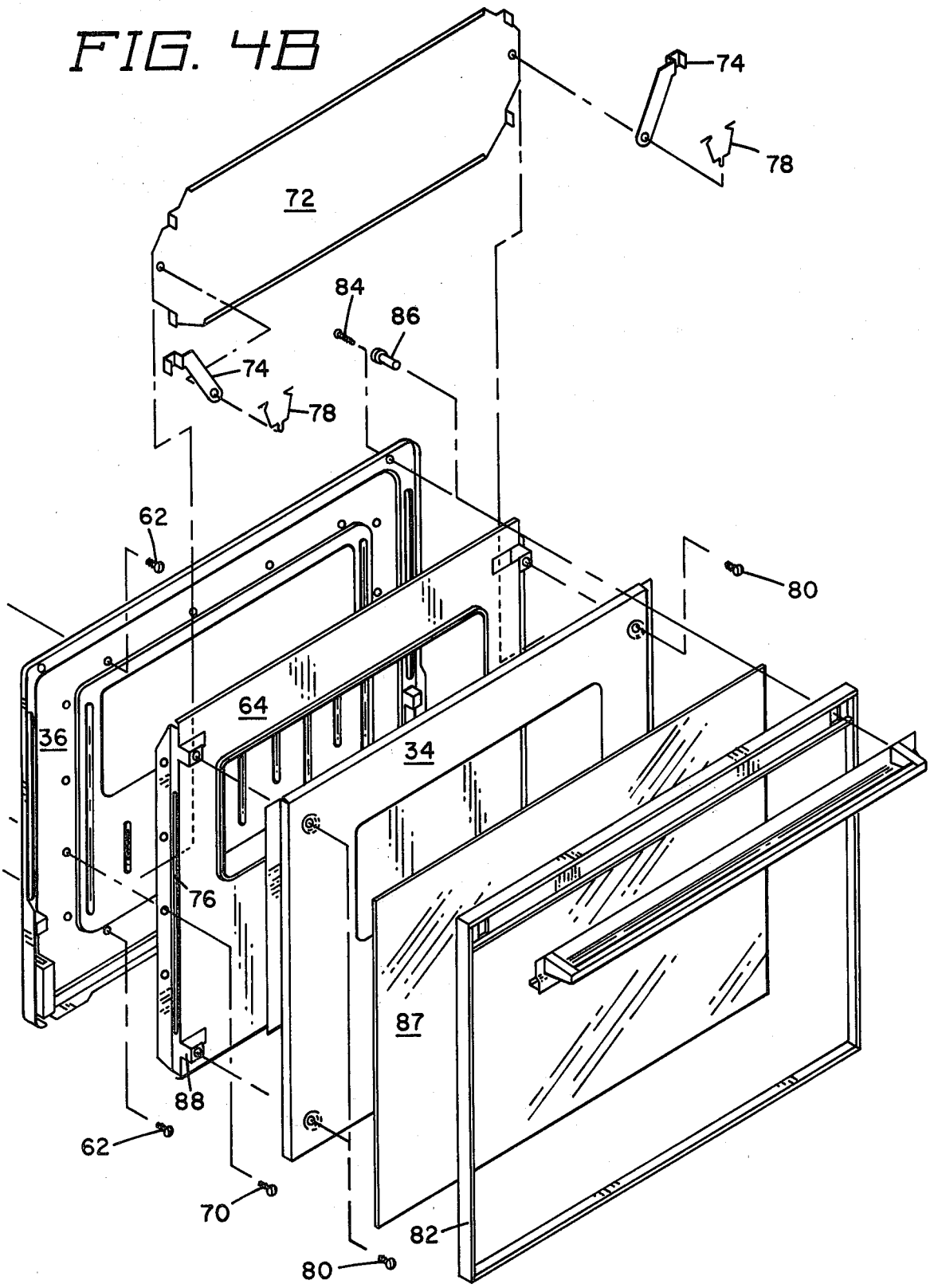

As is best seen in FIGS. 4A, 4B and 2, the oven door 20 is of generally sheet metal construction having three main elements, that is, an outer door panel 34, an inner door liner 36 and a floating inner panel 38.

Referring particularly to FIGS. 4A and 4B in view of FIG. 1, an inner glass panel 40 slides inside the aperture in floating inner panel 38 and rests against lip 42. Perforated window and choke assembly 44 slides in behind and abutts inner glass panel 40. Assembly 44 is secured into position by screws 46. Behind assembly 44 is located outer glass panel 48 which is secured to assembly 44 by retaining clips 50.

Floating inner panel 38 together with panel 40, assembly 44 and panel 48 forms a window subassembly 52 in the door 20. Subassembly 52, and more particularly inner glass panel 40, extends somewhat inside oven liner 18 when door 20 is closed. The outer rim or periphery of floating inner panel 38, including slots 54, together with the outer lip portion 56 of oven liner 18 forms a slotted door choke structure as more fully described in U.S. Pat. No. 3,767,884 which is hereby incorporated by reference.

With inner glass panel 40 exposed to the interior of baking oven 16, the possibility exists for the glass panel 40 to be broken due to accidental contact with any one of the many objects that are normally used in or around cooking appliances generally. Should glass panel 40 be broken, it may be easily replaced by disassembly and reassembly of window subassembly 52 in reverse fashion to that described above without materially affecting the integrity of the microwave seal around the periphery of window and choke assembly 44. This is due primarily to the fact that assembly 44 does not rely on a mechanical contact to seal in the microwave radiation as the result of a novel choke structure to be described.

Window subassembly 52 is fastened to the remainder of door 20 as shown most clearly in FIGS. 4A and 4B. Gasket 58 is positioned behind tabs 60. Inner door liner 36 is attached to floating inner panel 38 at tabs 60 by screws 62. Heat shield retaining panel 64 is attached to panel 38 by screws 70. Heat shield 72 is supported on retaining panel 64 by levers 74 that slip through channels 76 in panel 64 and that are tensioned by springs 78. The exact fashion in which levers 74 are connected and operated to move shield 72 has been omitted for the sake of brevity since it may be accomplished in numerous ways well-known in the art. One method is shown and described in U.S. Pat. No. 3,311,106 which is hereby incorporated by reference.

Outer door panel 34 is attached to panel 64 by screws 80. To liner 36 is secured decorative door trim ring 82 by screws 84 and spacers 86. Decorative glass door panel 87 is pressed between inner door liner 36 and ring 82 for added attractiveness.

The resultant door construction is shown in cross-section in FIG. 2. Through the use of spacers 86 through which screws 84 pass and brackets 88 on retaining panel 64 through which screws 80 pass, an air passage 90 is created between retaining panel 64 and outer door panel 34. Air passage 90 allows cooling air to enter through apertures (not shown) in the bottom of the door 20 and exit through apertures (not shown) in the top due to the natural convection created by the hot air in the oven 16 conductively heating the door 20. In this manner, the decorative glass door panel is maintained at a lower temperature for user convenience.

As shown in FIG. 2, the area between floating inner panel 38 and inner door liner 36 is filled with a suitable insulating material such as fiberglass 89. FIG. 2 also illustrates in cross-section the configuration of the perforated window and choke assembly 44. The area of assembly 44 in an enlarged scale is also shown in FIG. 3.

Assembly 44 is formed from perforated, die formed sheet metal or other suitable conductive member with apertures of sufficiently small size to suppress the leaking of microwave energy directly through the window opening as is well-known in the art. The outer periphery of assembly 44 is bent by standard techniques to form a microwave seal between assembly 44 and slide portions 92 of floating inner panel 38. The microwave seal is formed by a structure comprising slide portions 92 and a perforated metal wall 94 of an input section 96 of the microwave seal. The metal wall 94 of assembly 44 extends parallel to slide portions 92 of panel 38 and is spaced therefrom by a sufficient distance to provide clearance when assembly 44 is slid into position against lip 42 as already described.

On the opposite side of wall 94 from slide portions 92 is a branch transmission line section 98 which is coupled to the input section 96 in a coupling region 100 beyond the end of wall 94. The effective electrical length of the input section 96 from the oven 16 to the coupling region 100 is preferably approximately one-quarter wave length of the center frequency of the microwave feed 24.

Branch line 98 extends back along wall 94 which forms one wall of branch line 98 to an end plate 102 to which wall 94 is a part. End plate 102 is electrically connected as, for example, by spot welding at point 104 to a second perforated member 106 which has a portion 108 extending from its region of contact with end plate 102 substantially parallel to wall 94 for a distance beyond the end thereof. An extension of wall portion 108 is formed into a second end plate 112 that is substantially parallel to end plate 102. An extension 114 of end plate 112 is bent around slide portions 92 and attached thereto by screws 46.

During operation of the range 10, the integrity of the microwave seal formed by screws 46 contacting slide portions 92 with extension 114 is not of critical importance. With proper dimensioning, the above-described choke presents a capacitive impedance at the opening to the branch transmission line 98, i.e., at coupling region 100, thus establishing an E field. No H field can exist at the choke opening. Without an E cross H field, electromagnetic energy cannot be transmitted, and energy cannot leak from the area of screws 46.

From the foregoing, it is apparent that all of the objectives of the invention have been achieved by the oven door shown and described. Hence, it is apparent that various modifications and changes may be made by those skilled in the art without departing from the spirit of the invention as expressed in the accompanying claims. Therefore, all matter shown and described is to be interpretated as illustrative and not in a limiting sense.

What is claimed is:

1. A windowed door for a microwave oven, comprising:

an inner metal panel having a first side facing the cavity of said oven and a second side facing away from said cavity as defined with said door closed, said panel having an aperture for providing a window in said door;

a metal plate positioned on said second side of said panel, said plate being aligned with said aperture and spaced from said panel defining a passageway from said cavity through said aperture and around said plate;

said plate having a plurality of perforations for viewing said cavity;

a first choke-coupling microwave seal communicating with a peripheral region of said plate for preventing the escape of microwave energy from said cavity along said passageway;

a microwave and light transparent glass pane seated between said metal plate and said second side of said panel, said pane covering said aperture; and a second choke-coupling microwave seal positioned at the perimeter of said metal panel for suppressing leakage of microwave energy from said cavity through the gap between the access opening and said perimeter.

2. The door recited in claim 1 further comprising a metallic tunnel connected to said second side of said panel and extending outwardly surrounding said glass pane and said plate.

3. The door recited in claim 2 further comprising perpendicular edges from said plate extending parallel with said tunnel, the input section of said choke-coupling microwave seal comprising portions of said tunnel and said edges.

4. The door recited in claim 3 wherein the choke section of said choke-coupling microwave seal is connected to said plate.

5. The door recited in claim 4 further comprising an outer metal panel spaced from said inner panel and having an aperture aligned with said tunnel.

6. A windowed door for a combination microwave and thermal oven, comprising:

inner and outer metal panels each having an aperture aligned with the other aperture for providing a window in said door, said inner metal panel having a first side facing the cavity of the oven and a second side facing away from said cavity as defined with said door closed;

a metal plate positioned between said inner and outer panels, said plate being aligned with said aperture of said inner panel and spaced therefrom defining a gap between a peripheral region of said plate and said second side of said inner panel;

said plate having a plurality of perforations for viewing said cavity when said door is closed;

a first choke-coupling microwave seal having its input section communicating with said peripheral region of said plate for preventing leakage of microwave energy through said gap;

a microwave and light transparent glass pane seated between said metal plate and said second side of said inner panel, said pane covering said aperture in said inner panel; and a second choke-coupling microwave seal positioned at the perimeter of said metal panels for suppressing leakage of microwave energy from said cavity through the gap between the access opening and said perimeter.

7. The door recited in claim 6 further comprising a metallic tunnel connected to said second side of said inner panel and extending outwardly towards said outer panel, said tunnel surrounding said glass pane and said plate.

8. The door recited in claim 7 further comprising perpendicular edges from said plate extending parallel with said tunnel, said edges defining a portion of said input section of said choke coupling microwave seal.

9. The door recited in claim 8 wherein said plate is connected to said tunnel at a position outside the output section of said choke-coupling microwave seal.

10. A windowed door for closing the access opening of the cavity of a combination microwave and thermal oven, comprising:

inner and outer metal panels each having an aperture aligned with the other aperture for providing a window in said door, said inner panel having a first side facing said cavity and a second side facing away from said cavity as defined with said door closed;

a first choke-coupling microwave seal communicating with peripheral portions of said inner and outer panels to suppress leakage of microwave energy between said door and wall portions of said access opening;

a substantially rectangular metal tunnel having top, bottom and side walls connected to said second side of said inner panel surrounding said aperture, said inner panel having a lip extending into said tunnel, said tunnel extending towards said outer panel;

a metal plate in said tunnel and perpendicular to said walls thereof, said plate being spaced from said tunnel defining a perimeter gap between said plate and portions of said top, bottom and side walls of said tunnel, said plate having a plurality of perforations for viewing said cavity through said tunnel;

a second choke-coupling microwave seal for suppressing leakage of microwave energy from said cavity down said tunnel through said gap; and a microwave and light transparent glass pane positioned between said plate and said second side of said inner panel, said pane being peripherally seated against said lip and said plate being removably mounted to wall portions of said tunnel on the output side of said second choke-coupling microwave seal.

* * * * *